United States Patent [19]

Stein

[11] Patent Number: 4,592,465

[45] Date of Patent: Jun. 3, 1986

[54] COIN DISPLAY CASE

[75] Inventor: Edmund W. E. Stein, Dover, Mass.

[73] Assignee: Design Pak, Incorporated, Marlboro, Mass.

[21] Appl. No.: 551,288

[22] Filed: Nov. 14, 1983

[51] Int. Cl.[4] ..... A45C 11/24

[52] U.S. Cl. ..... 206/0.83; 206/0.84; 206/0.8; 206/523; 206/45.14

[58] Field of Search ..... 206/0.8, 523, 0.83, 206/0.84, 45.14, 559, 562, 563

[56] References Cited

U.S. PATENT DOCUMENTS

| | | | |
|---|---|---|---|
| 3,139,977 | 7/1964 | Burdick | 206/0.83 |
| 3,145,833 | 8/1964 | Muller | 206/0.83 |
| 3,217,866 | 11/1965 | Phelps | 206/0.83 |
| 4,294,349 | 10/1981 | Ibsen et al. | 206/523 |
| 4,341,300 | 7/1982 | Roy | 206/523 |
| 4,402,399 | 9/1983 | Friess | 206/0.83 |
| 4,446,900 | 5/1984 | Markvoich | 206/523 |

*Primary Examiner*—Joseph Man-Fu Moy

[57] ABSTRACT

A coin display case includes an outer lens, an inner lens and a central laminate. The laminate is held between the outer lens and the inner lens. The laminate further includes a hole for accepting a coin. The laminate is made out of a layer of flexible foamed material sandwiched between two layers of sulfur-free acid neutral paper.

3 Claims, 2 Drawing Figures

COIN DISPLAY CASE

FIELD OF THE INVENTION

This invention relates to coin display cases.

BACKGROUND OF THE INVENTION

Prior art coin display cases have included a pair of joined transparent plastic elements (called lenses) holding therebetween a rigid thin plastic member pierced with holes to accept coins to be displayed.

SUMMARY OF THE INVENTION

I have discovered that a significantly improved coin display case results if in the construction just described there is substituted for the rigid plastic intermediate element a flexible element comprising foam material for engaging coins pressed in the holes.

In preferred embodiments the intermediate element is a laminate of two exterior layers of sulfur-free acid-neutral paper, with sandwiched between them a layer of crossedlinked close-cell polyethylene.

PREFERRED EMBODIMENT

We turn now to a description of the drawings, structure, and operation of a preferred embodiment.

DRAWINGS

STRUCTURE

Figure 1:
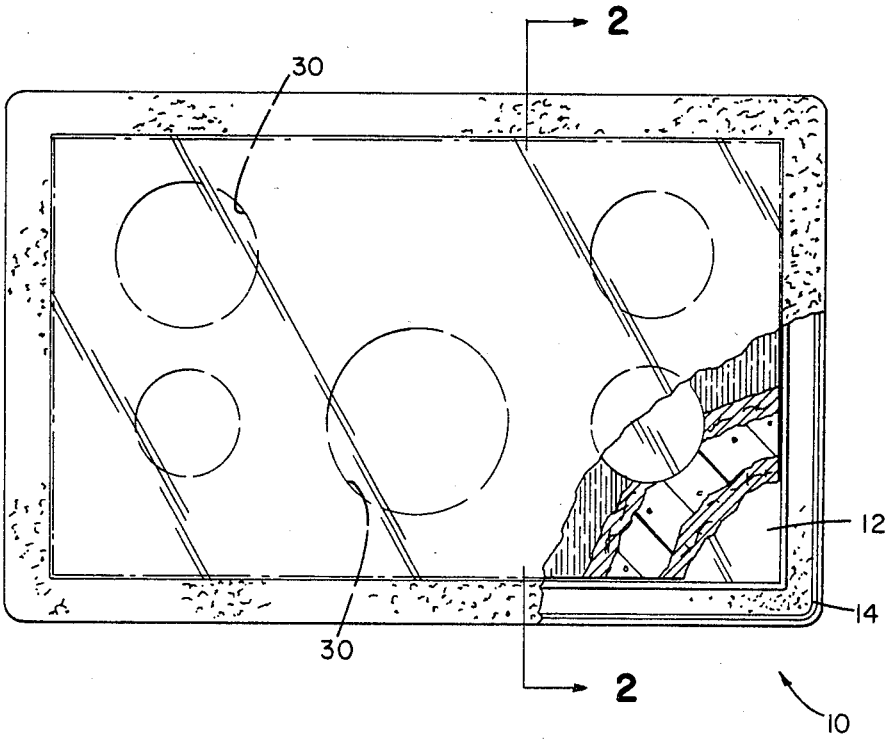
FIG. 1 is a plan view, partially broken away, of said preferred embodiment.
Figure 2:
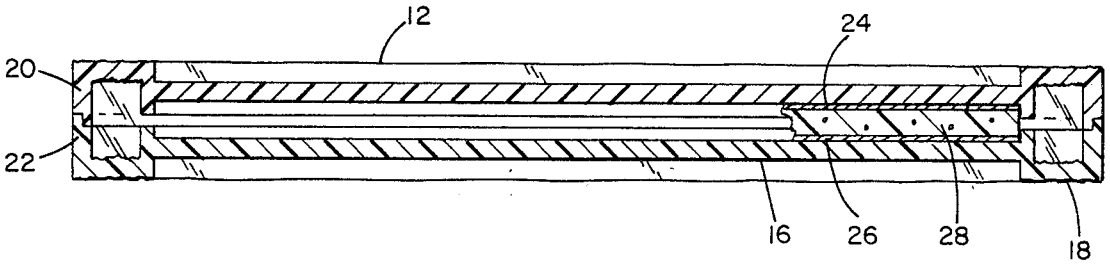
FIG. 2 is a vertical sectional view taken at 2—2 of FIG. 1.

In FIG. 1 is shown a coin display case indicated generally at 10.

Coin display case 10 includes upper clear plastic lens 12 with integral textured-surface (for opaqueness) rim 14. There is also lower lens 16 with textured rim 18, the lower element being of generally similar construction to the upper, and being joined thereto around the rims 20 and 22 thereof ultrasonically. Held between lenses 12 and 16 is a laminate consisting of upper layer 24 and lower layer 26, both of pH neutral paper having a basis weight of 133 and a caliper of 12 points. Sandwiched therebetween is layer 28 of crossedlinked closed-cell acid-neutral polyethylene.

OPERATION

The flexibility of the foam layer 28 not only holds coins placed in holes 30 throught the three layers of the intermediate laminate against rotation, but provides for increased tolerance in hole diameter manufacturing limitations. The inertness of the three layers of the laminate, from the standpoint of both acids and sulfur, prevents tarnishing of coins. The construction allows outer layers of any color desired.

Other embodiments within the scope of the following claims will occur to those skilled in the art.

What is claimed is:

1. A coin display case comprising an outer lens, an inner lens, and a central laminate, said laminate being held between said outer lens and said inner lens, said laminate having at least one hole therethrough for accepting therein a coin to be displayed and held cooperatively with said outer lens and said inner lens, and said laminate comprising a layer of flexible foamed material sandwiched between two layers of sulfur-free acid neutral paper.

2. The coin display case of claim 1 in which said foamed layer is closed-cell.

3. The coin display case of claim 2 in which said foamed layer is of a crossedlinked polyethylene.

* * * * *